United States Patent [19]

Maasberg

[11] 3,942,214

[45] Mar. 9, 1976

[54] WASHING AND VACUUMING VEHICLE CONSTRUCTION

[75] Inventor: Wolfgang Maasberg, Krudenburg, Germany

[73] Assignee: Woma-Apparatebau, Wolfgang Maasberg & Co. GmbH, Rheinhausen, Germany

[22] Filed: May 9, 1974

[21] Appl. No.: 468,362

[30] Foreign Application Priority Data

May 10, 1973 Germany ..... 2323588

[52] U.S. Cl. ..... 15/320; 15/340; 15/353

[51] Int. Cl.[2] ..... E01H 1/08; E01H 1/10

[58] Field of Search ..... 15/320, 340, 353, 345, 15/346

[56] References Cited

UNITED STATES PATENTS

| | | | |
|---|---|---|---|
| 2,916,761 | 12/1959 | Oberg | 15/340 X |
| 3,007,191 | 11/1961 | Braun | 15/340 |
| 3,065,490 | 11/1962 | Arones | 15/359 |
| 3,447,188 | 6/1969 | Maasberg | 15/320 |
| 3,675,267 | 7/1972 | Klawitter | 15/340 |
| 3,833,961 | 9/1974 | Fortman et al. | 15/320 X |

*Primary Examiner*—Harvey C. Hornsby
*Assistant Examiner*—C. K. Moore
*Attorney, Agent, or Firm*—McGlew and Tuttle

[57] ABSTRACT

A vehicle, contains a washing and vacuuming machine for cleaning streets and similar surfaces, which includes a wheeled body containing a tank which holds cleaning water or a similar liquid, and a pump for directing the water through a spray nozzle which is positioned in a hood located below the body adjacent the ground. A vacuuming suction shoe is located within the hood forwardly in the travel direction in respect to the nozzle so that the nozzle is aimed forwardly toward the intake of the suction shoe which is spaced upwardly from a perimetric skirt element of the hood. The hood is advantageously carried on a separate carriage which is biased by a suitable washing arrangement so that it moves inwardly toward one side of the vehicle, for example, toward the curb side. The carriage is adapted to have guide wheels which engage along the curb so that the vacuuming device and spray nozzle will be directed in a location adjacent the curb to effect the cleaning thereof. The suction shoe is connected, for example, by a flexible connection extending through the hood into a compartment of the vehicle body which is maintained under negative pressure or vacuum by a suction device, such as a blower, and the debris which is picked up by the suction shoe is directed into the compartment and over a screened area which has a spray for keeping the screen clean and for settling the dust within a rear compartment of the vehicle.

9 Claims, 3 Drawing Figures

WASHING AND VACUUMING VEHICLE CONSTRUCTION

BACKGROUND OF THE INVENTION

1. Field of the Invention

This invention relates in general to the construction of street cleaning vehicles and, in particular, to a new and useful washing and vacuuming vehicle which includes a suction shoe located in a hood portion carried below the vehicle body which is provided with a skirt around its periphery for engagement over the ground, and which includes a nozzle in the hood for directing liquid in the direction of an intake of the suction shoe which is spaced slightly above the sealing slot which the hood makes with the ground.

2. Description of the Prior Art

At the present time it is known to employ hydraulic jets for aiding in the cleaning and vacuuming of streets and these are usually arranged at an angle of from 30 to 45° with respect to the street so that the debris is deflected upwardly by the jet and collected in a filtering system which removes the water for re-use. The cleansing effect is based on the reflection of the hydraulic jets which are intended to entrain the dirt or debris deposited at the point of reflection. The hydraulic jets which are employed are used under pressures of up to 100 atmospheres in excess. The collecting channels for receiving the slurries and debris require improvement inasmuch as they permit a very large loss of water. For this reason, it has already been proposed to use suction devices and suction funnels instead of the collection channels and to direct the hydraulic jets below the suction funnels by means of hydraulic nozzles. With such an arrangement, the hydraulic nozzles are located behind the suction funnels in respect to the traveling direction of the vehicle, and pneumatic nozzles are arranged before the suction funnels. The pneumatic nozzles provide a barrier in respect to the reflected water jets and debris. In spite of this barrier, however, the loss of water is still relatively high and the suction effect is frequently not sufficiently satisfactory for intense cleaning.

SUMMARY OF THE INVENTION

In accordance with the present invention, there is provided a washing and vacuuming device, designed as a vehicle, and operates with an extremely small loss of water and with an optimal cleaning effect which permits higher speed of motion than heretofore without raising dust and, consequently meets the requirements for maintaining a clean environment.

A vacuuming and washing device of the invention includes a vehicle having a body containing a liquid holding tank with a pump connected through a conduit and a spray nozzle which is located directly behind a suction shoe, all within an enclosed hood carried below the body adjacent the ground. The hood includes sealing means for spacing the hood above the ground and maintaining an opening slot for the passage of debris and water therethrough. The sealing means of the hood is such that only a small slot remains between the bottom of the hood and the ground to be cleaned so that the ambient air penetrates into the hood during the cleaning and vacuuming operation. An entrainment effect is thereby caused by the air penetrating therein. The air taken in entrains the street dirt removed by the water pressure and also the slurry which is produced as a result thereof. In consequence, the suction effect is considerably improved. In addition, because of the location of the spray nozzle and the suction shoe under the same hood, there is no likelihood that any stray water jets or slurry will not be evacuated at the same time. The effect is that even the air from within the hood is drawn off by means of the suction shoes so that an underpressure is produced under the entire hood.

In accordance with another feature of the invention, the hood structure including the suction shoe and the spray nozzle is mounted on a trailer which is pivotally connected to the vehicle and which may be swung laterally in respect thereto. The trailer is advantageously carried on a parallel linkage and it is urged or biased in a particular lateral direction, for example, in a direction to cause it to move toward the curb of the street being cleaning. The urging device may advantageously comprise a spring or a hydraulically or pneumatically actuated device, and the vehicle is advantageously provided with rollers which rotate about a vertical axis and which may engage laterally against the curb. The rollers provide a guide for ensuring the proper spacing of the vehicle in respect to the curb of the street. In the preferred arrangement, the hood is provided with peripheral sealing means which are spaced above the surface to be cleaned by a distance of up to 5mm, and no greater than 20mm maximum, so that an optimal entrainment effect is produced.

The advantages obtained by the invention are to be seen primarily in the fact that a washing and suction machine designed as a vehicle for cleaning streets or similar surfaces is created which has a minimum water loss so that the entire reserve of water except for an extremely small loss can be recirculated. In addition, an optimum cleaning effect is obtained and the anti-pollution requirements are met since practically no dust is raised, or it is collected in the hood surrounding the spray beam and the suction shoe, from where it is evacuated. As a result, the inventive vehicle can be driven at a higher speed than before, and also, it can perform the cleaning operations at a higher speed so that a greater performance per kilometer and time, and a greater cleaning effect is obtained. Finally, in the absence of mechanical brushes or the like, no wearing working parts are present.

Accordingly, it is an object of the invention to provide an improved washing and vacuuming vehicle, particularly for street cleaning, which comprises a vehicle having a body containing a pump with a supply of a liquid for cleaning purposes, which is connected to a nozzle which is contained in a hood structure located below the body adjacent the ground, which also contains a suction shoe which is connected through the hood to a suction chamber maintained under vacuum pressure by a suitable suction producing device and wherein, the hood includes a sealing means which provide a slot spacing from the street to be cleaned around the periphery of the hood.

A further object of the invention is to provide a street vacuuming and washing device which is simple in design, rugged in construction, and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there is illustrated a preferred embodiment of the invention.

DESCRIPTION OF THE PREFERRED EMBODIMENT

Figure 1:
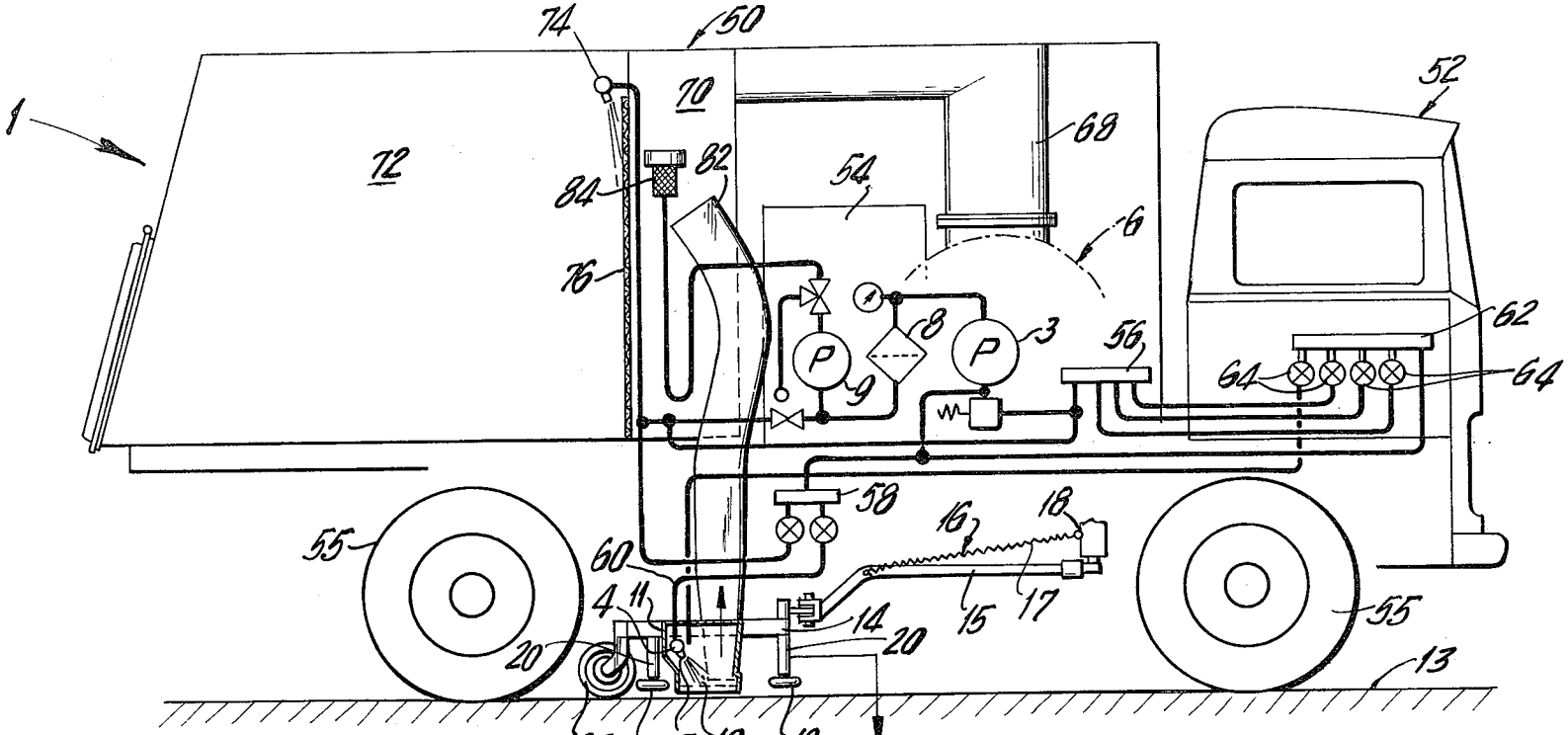
FIG. 1 is a schematic side elevational view of a street cleaning vehicle constructed in accordance with the invention.
Figure 3:
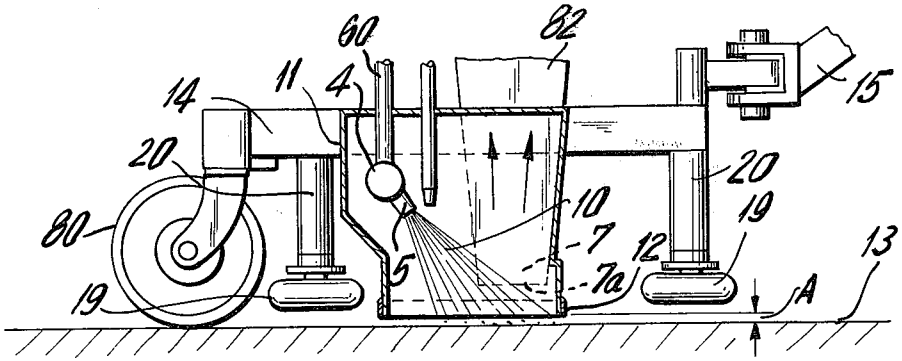
FIG. 3 is an enlarged partial sectional and partial elevational view of the hood carriage of the device shown in FIG. 1.
Figure 2:
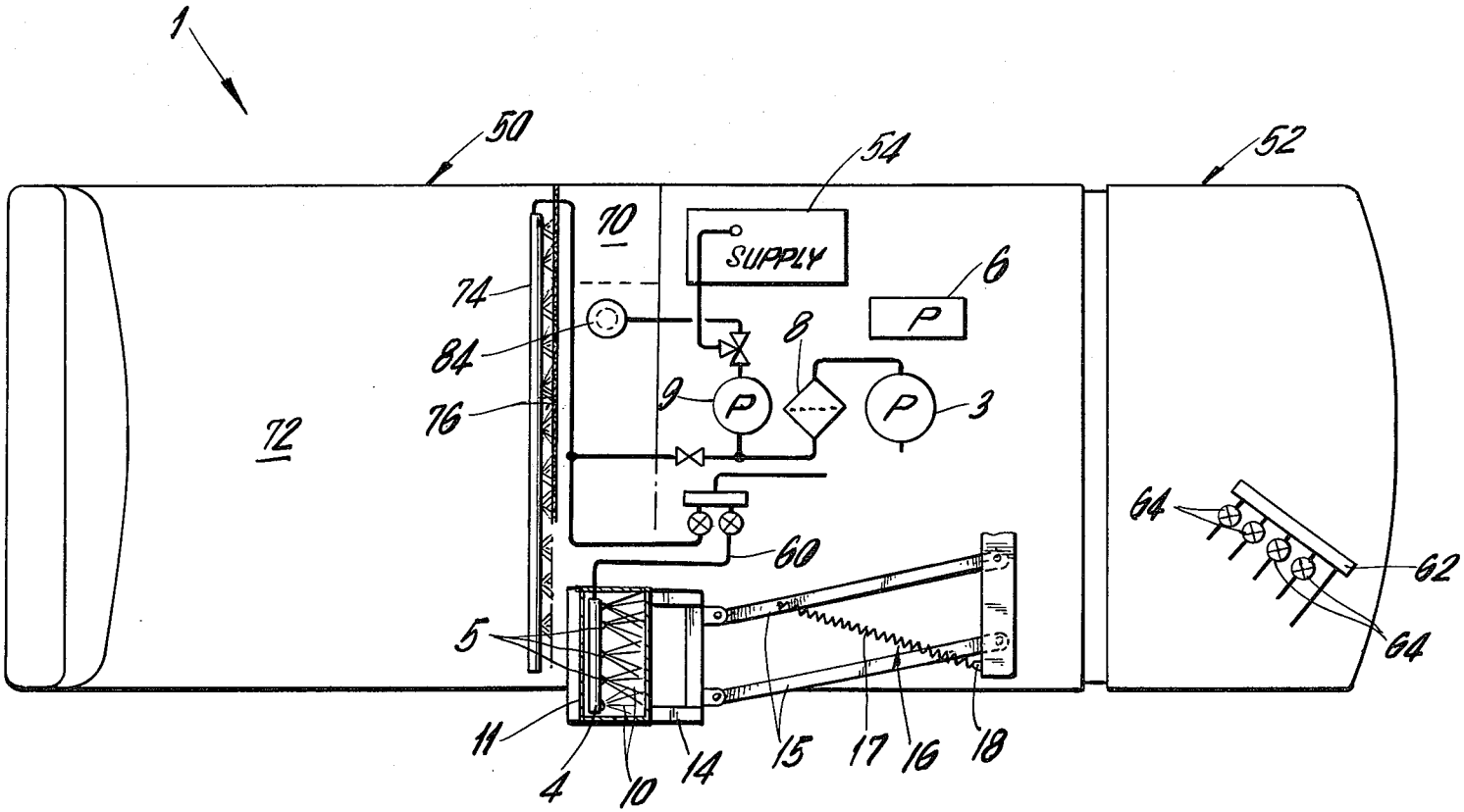
FIG. 2 is a schematic top plan of the vehicle shown in FIG. 1.

Referring to the drawings in particular, the invention embodied therein, comprises a street cleaning vehicle or washing and vacuuming vehicle, generally designated 1, which includes a body portion, generally designated 50, and a forward cab portion 52, which are mounted on wheels 55 for movement over the ground or street 13 for cleaning it. The vehicle body contains a water or suitable cleaning liquid supply tank 54 which is connected through circulating pumps 3 and 9 through the variously indicated connecting conduits and controlled headers 56 and 58 to a cleaning water discharge conduit 60 which has a swivel joint 4 at its end thereof for a nozzle 5 which is oriented to direct a spray jet 10 forwardly in respect to the vehicle travel direction toward a vacuum suction tube or suction shoe 7. A suitable control manifold 62 is located in cab 52 and it includes associated control elements 64 for operating the various operating devices.

The body 50 contains suction producing means, such as a vacuum pump 6, which is connected through a conduit 68 to a tank or chamber 70. Chamber 70 in turn discharges into a collecting bin 72 for the debris and slurry which is collected. The apparatus includes a small spray 74 for spraying a screen structure 76 through which the collected debris is collected.

In accordance with the invention, both the suction shoe 7 and the spray nozzle 5 are located within a hood 11 which is carried below the body 50 adjacent the street 13. In accordance with a feature of the construction, hood 11 is carried so that perimetric skirt 12, extending therearound, provides a semi-sealing action with street 13 which is sufficient to permit the inflow of air and debris without loss of too much water or suction. For this purpose, the dimension A indicating the spacing of the street surface 13 from the bottom of skirt 12 defines a slot which is up to 5 mm in dimension. The maximum at the slot may be at about 20 mm.

In accordance with another feature of the invention, hood 11 is carried on a trailer or carriage 14 which includes a rear wheel 80 which is mounted on a swivel so that the carriage may be swung from side to side. Carriage 14 is attached to the vehicle by means of a parallel linkage 15 which permits the lateral movement of the carriage and it is biased in a selected direction, for example, to the right side of the vehicle by biasing means 16 which, in the embodiment illustrated, is a spring 17. Spring 17 is connected at one end to linkage 15, and at its opposite end, to a fixed location 18, which is located to one side of linkage 15, for example, to the right side of the vehicle so that it is urged in a right side direction. The carriage also carries guide rollers 19, 19 which are mounted for rotation about vertical axes 20, 20 and which are at a height such that they may engage against a street curb to provide a guiding movement for the device during the cleaning of streets. Instead of spring 17, a suitable arrangement for guiding the carriage 14 would be a hydraulically or pneumatically actuated working piston and cylinder assembly connected to one side of the parallel linkage 15.

During operation, spray 10 is always guided forwardly against the suction opening 7a of suction shoe 7 and the debris and liquid slurry formed are directed upwardly in the dust shoe 7 through a flexible connecting chute 82, for discharge into compartment 70 and subsequently, the compartment 72. Conduit 60 is also suitably connected through a flexible connecting conduit to the conduits connected to the pumps 9 and 3. A suitable filter 8 is located within the connecting line so that when the liquid is re-used, it is not contaminated. A strainer 84, located in compartment 70 containing the liquid slurry, permits the draining off of some of the liquid from the compartment back into tank 54.

While a specific embodiment of the invention has been shown and described in detail to illustrate the application of the principles of the invention, it will be understood that the invention may be embodied otherwise without departing from such principles.

What is claimed is:

1. A washing and suction device comprising a vehicle having a body with wheels for moving it along the ground, a water supply tank on said body, a suction producing device on said body, a suction shoe having a lower end spaced above the ground and its opposite end being in fluid communication with said suction producing device, a hood carried by said body and located therebelow and enclosing said suction shoe and having a bottom with a suction opening, a spray conduit connected to said tank and having a nozzle terminating inside said hood behind said suction shoe and directing a wash spray forwardly in a travel direction toward said suction shoe, and a skirt extending around the perimeter of said bottom opening of said hood and spaced above the ground so as to provide a perimetric slot opening between said skirt and the ground to facilitate the inflow of air and debris to said suction shoe, and to confine said wash spray and raised debris within said hood to diminish pollution of the ambience thereby.

2. A washing and suction device according to claim 1, including a trailer connected to said vehicle body and carrying said hood with said suction shoe and said spray conduit and nozzle.

3. A washing and suction device, according to claim 2, including a parallel linkage connected between said trailer and said vehicle body, said trailer being movable laterally in respect to said vehicle body, and means for biasing said trailer in a selected lateral direction.

4. A washing and suction device according to claim 3, wherein said means for biasing said trailer comprises a spring connected to a fixed part of said vehicle body and to said parallel linkage.

5. A washing and suction device according to claim 1, wherein said skirt is spaced from the ground upwardly to substantially 5 mm and no more than 20 mm.

6. A washing and suction device according to claim 1, including a carriage articulated to said vehicle body and carrying said hood with said suction shoe and said spray nozzle.

7. A washing and suction device according to claim 6, including guide roller means on said carriage engageable with a street curb for guiding the carriage in respect thereto.

8. A washing and suction device according to claim 7, wherein said guide rollers are rotatably mounted on said carriage for rotation about a substantially vertical axis and they are at a height to engage against a side of a curb.

9. A washing and suction device according to claim 1, including a slurry receiving tank in said vehicle body, a return conduit connected between said slurry receiving tank and said water supply tank having strainer means for straining the contents of said receiving tank and permitting the flow of the water therein back to said water supply tank, and a flexible connection extending from said suction shoe into said receiving tank, said receiving tank being connected to said suction producing device.

* * * * *